United States Patent [19]

Matthews

[11] 4,064,380

[45] Dec. 20, 1977

[54] MOVABLE CONTACT CARRIER FOR AN ELECTRICAL CONTROL

[75] Inventor: Benjamin H. Matthews, Peninsula, Ohio

[73] Assignee: Lucerne Products, Inc., Hudson, Ohio

[21] Appl. No.: 661,127

[22] Filed: Feb. 25, 1976

[51] Int. Cl.[2] ..... H01H 15/00

[52] U.S. Cl. ..... 200/16 C; 200/16 R; 200/67 G; 200/243; 200/313; 200/315

[58] Field of Search ..... 200/16 R, 16 C, 67 G, 200/68, 77, 154, 157, 243, 284, 308, 310, 313, 315

[56] References Cited

U.S. PATENT DOCUMENTS

| | | | |
|---|---|---|---|
| 3,222,488 | 12/1965 | Matthews | 200/243 |
| 3,415,966 | 12/1968 | Matthews | 200/153 |
| 3,536,973 | 10/1970 | Matthews et al. | 200/157 X |
| 3,598,934 | 8/1971 | O'Connor | 200/16 R |
| 3,610,860 | 10/1971 | Baldwin | 200/315 |

*Primary Examiner*—Volodymyr Y. Mayewsky
*Attorney, Agent, or Firm*—Baldwin, Egan, Walling & Fetzer

[57] ABSTRACT

This invention relates to an electrical switch actuated by a longitudinally reciprocatable contact carrier and such reciprocation being brought about by tilting of a rocker actuator by means of a push button effect.

1 Claim, 14 Drawing Figures

MOVABLE CONTACT CARRIER FOR AN ELECTRICAL CONTROL

BACKGROUND OF THE INVENTION

Switches of the character shown herein have been heretofore operated by a slide button which has some disadvantages which are overcome by the improved push button actuator disclosed herein.

An object of the present invention is to provide a rocker actuator, operatively associated with a longitudinally reciprocatable bridge contactor so that pressure on one arm of the rocker actuator will move the bridge contactor to a switch "on" position, and movement of the other arm of the rocker actuator will move the bridge contactor to switch "off" position.

Other objects and advantages of the invention will be apparent from the accompanying drawings and description taken in conjunction with the drawings, wherein:

FIG. 13 is a sectional view taken along the line 13—13 of FIG. 12; while

Although the invention is shown and described herein with reference to its application in portable electric tools, it will be understood that it may be used in any application to control the application of electrical energy to an applied load.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

Figure 1:
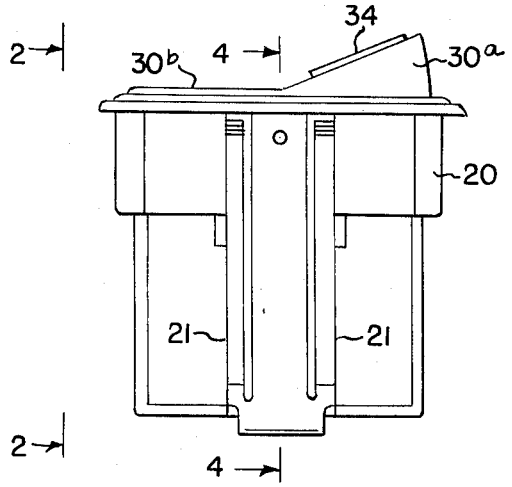
FIG. 1 is a side elevational view of a portable tool switch constructed in accordance with the invention.
Figure 2:
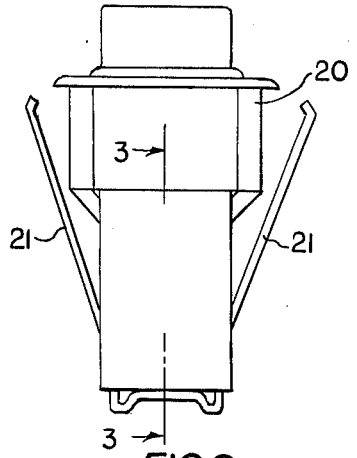
FIG. 2 is a side elevational view of the same taken along the line 2—2 of FIG. 1.
Figure 3:
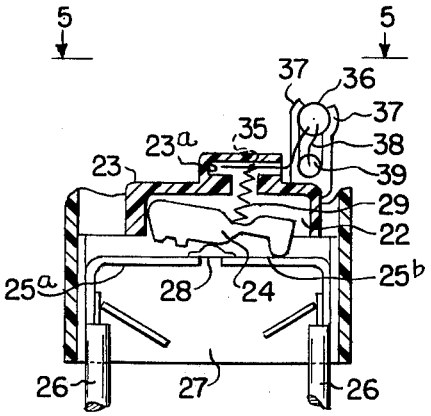
FIG. 3 is a fragmental sectional view taken along the line 3—3 of FIG. 2.
Figure 7:
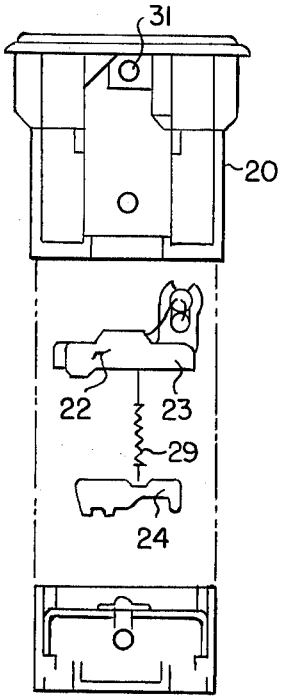
FIG. 7 is an exploded view showing from the top down the switch housing, the contact carrier, the bridge contactor and the plastic module which carries the stationary switch contacts.

Referring to the drawings, there is shown in FIGS. 1 and 2 an electric switch for portable electric motor-driven tools including a switch housing 20 which may be provided with resilient spring arms 21 by which the housing may be retained in a suitable opening a motor-driven tool. A switch device 22 is disposed in the housing 20 and the same consists of a contact carrier 23 reciprocatable longitudinally, or laterally as seen in FIGS. 3 and 7, within which is carried a bridge contactor member 24. This type of switch device is disclosed and claimed in the assignee's U.S. Pat. No. 3,222,488, granted to Benjamin H. Matthews on Dec. 7, 1965. This switch device comprises four stationary electrical contact members **25*a* and 25*b* seen in FIG. 3 and two other stationary contacts on the opposite side of the switch structure as will later appear, the same not being shown in the drawings. Each stationary contact is provided with electrical power connections as shown at 26. These parts are shown carried by a plastic module 27. An upwardly extending projection 28 is provided on the module 27 located between the contacts 25*a* and 25*b* and causing the bridging contactor 24 to be carried from the "off" position shown in FIG. 3 with the left-hand end of the bridging contactor as seen in FIG. 3 raised above the fixed contact 25*a* until the bridging contactor reaches a position to the left of FIG. 3, whereupon the left-hand end of the contactor 24 will drop down into contact with the fixed contact 25*a* in switch "on" position. The switch device 22** will not be further described in detail as the same, per se, is thoroughly explained in the above mentioned Matthews U.S. Pat. No. 3,222,488 and forms no particular part of the present invention.

Figure 4:
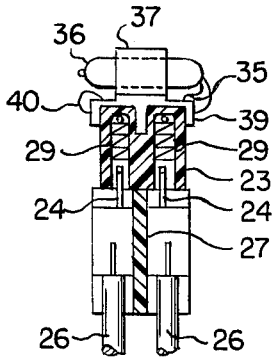
FIG. 4 is a sectional view taken along the line 4—4 of FIG. 1 but omitting the switch housing.
Figure 12:
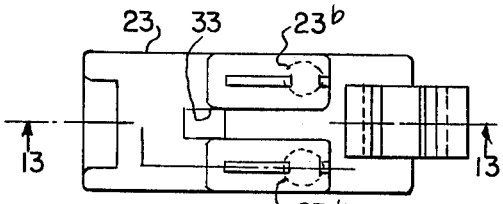
Figure 13:
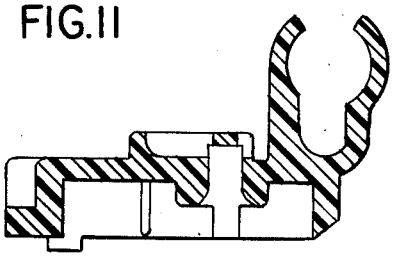

It will be seen in FIGS. 4 and 12 that the contact carrier 23 supports two of the bridging contacts 24 in side by side relationship, each bridging contactor reciprocating in one of the two parallel channels in the underside of the contact carrier. There is a pair of upstanding bosses **23*a* on the top of the contact carrier approximately intermediate the ends thereof and extending upwardly. A vertically extending bore 23*b* in each of these bosses opens downwardly into a respective one of said channels and a coil spring 29 in each of these bores is engaged with a respective switch device contactor 24** to urge the switch device downwardly into operative position.

Figure 8:
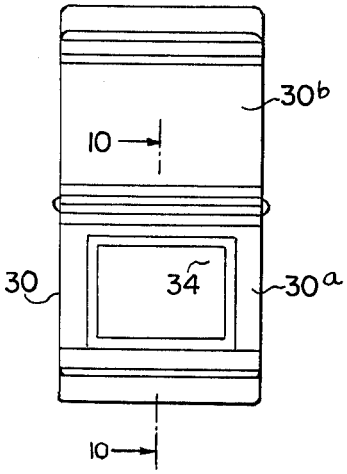
FIG. 8 is a top plan view, enlarged, of the rocker actuator.
Figure 9:
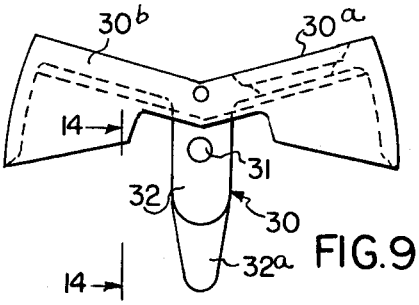
FIG. 9 is a side elevational view of the structure of FIG. 8.
Figure 11:
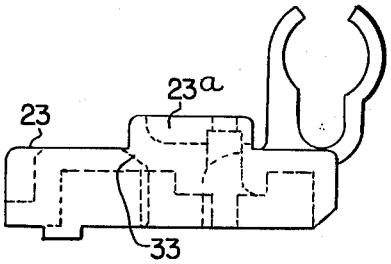
FIGS. 11 and 12 are side elevation and top plan views, respectively, of the contact carrier.
Figure 10:
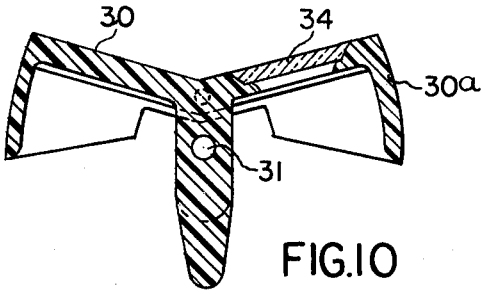
FIG. 10 is a sectional view taken along the line 10—10 of FIG. 8.
Figure 14:
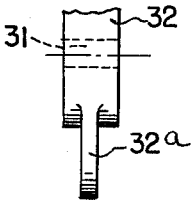
FIG. 14 is a fragmental elevational view taken along the line 14—14 of FIG. 9.

This invention provides a novel rocker actuator to reciprocate longitudinally the contact carrier 23. This actuator, as best seen in FIGS. 8, 9 and 10, and indicated at 30, has opposite ends **30*a* and 30*b* at the top, angularly related with a pivot connection at 31 between a mid-point of the rocker actuator and the housing 20. The angle between the faces 30*a* and 30*b* is such that, as seen in FIG. 1, when the face 30*a* is upwardly, with the switch in the "off" position, then the face 30*b* is approximately at the level of the top of the housing 20. Conversely, when the switch is in the "on" position, the face 30*b* will be raised above the top of the housing 20 and the face 30*a* will be approximately level with the top of such housing. The rocker actuator has a downwardly extending projection 32 centrally thereof and having a lower operating finger 32*a* as shown in FIGS. 9 and 14 which enters fairly loosely into a central slotted opening 33 opening upwardly in the center of the top of the contact carrier 23 so that pushing downwardly on the rocker arm 30*a* moves the carrier toward the left as seen in FIGS. 3 and 12, while pushing the arm 30*b*** downwardly moves the contact carrier toward the right as viewed in the same views.

Figure 5:
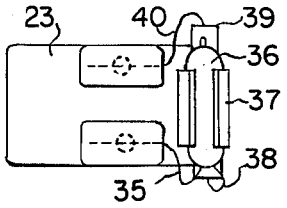
FIG. 5 is a top plan view of the contact carrier, seen in FIGS. 3 and 4.
Figure 6:
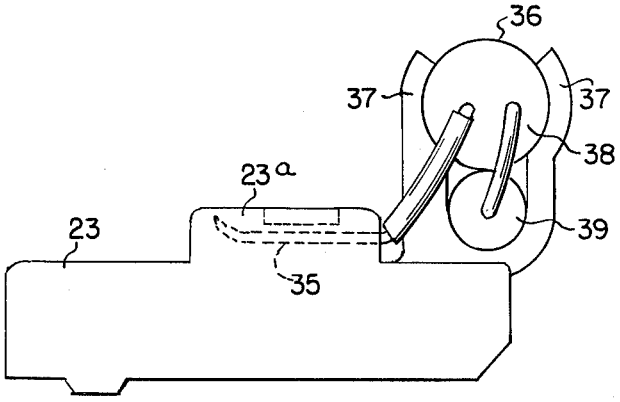
FIG. 6 is a side elevational view of the contact carrier of FIG. 5.

Preferably, but not necessarily, one of the rocker arms, such as **30*a*, as seen in FIGS. 1, 8, 9 and 10, is provided with a translucent plate 34 and means is provided to present a signal, such as a light, beneath the plate 34 when the switch device is in the "on" position. This means, as shown, in FIGS. 3, 5 and 6, comprises a conductive wire 35 from one spring 29 to a Neon light bulb 36 held between clip arms 37 which are part of the carrier 23. Another conductor 38 runs from the Neon bulb 36 to one end of a resistor 39 and another wire 40 connects the opposite end of the resistor 39 to the spring 29 on the opposite side of the contact carrier. It results from these connections that when the switch device is in the "on" position, the Neon bulb 36 is lit and shows through the plate 34** to call the operator's attention to the actuated position of the switch device.

It results from the use of this invention that a push button sort of operation applied either to the face 30*a* or 30*b* of the rocker actuator will supply longitudinal reciprocation of the bridging contacts 24 to move the switch device from "on" to "off" position, and vice versa, resulting in a substantially trouble-free operation of the switch device.

What is claimed is:

1. An electric switch for portable electric motor-driven tools comprising a switch housing formed of insulating material, a switch device disposed in said housing, comprising two pairs of stationary contacts mounted in said housing, each pair consisting of two contacts disposed in spaced relation longitudinally with respect to the axis of the housing, an insulative contact carrier disposed in said housing for reciprocation therein along the longitudinal axis of said carrier, said contact carrier having a pair of side-by-side elongated parallel channels in the underside thereof, a pair of contactor members each being disposed in one of said channels and arranged that longitudinal reciprocation of said contact carrier moves each side contactor member into engagement with the contacts of one of said pairs of stationary contacts to define the "on" position for said switch, said stationary contacts of each of said pairs adapted to be connected to the electrical power source for said tool, an insulative rocker actuator pivotally attached to said housing and interconnecting with said contact carrier and pivotally actuatable to slide said contact carrier to its said "on" position, translucent plate means in said rocker actuator, and signal means cooperating with said plate means for visually indicating the movement of said carrier to the "on" position of said switch comprising a lamp support on said carrier and movable therewith, a lamp disposed in said support, and conductor means connecting said lamp in circuit with the electrical power source connected to said stationary contacts with the switch in the "on" position.

* * * * *